US009541861B2

(12) United States Patent
Tauchi et al.

(10) Patent No.: US 9,541,861 B2
(45) Date of Patent: Jan. 10, 2017

(54) DEVELOPING DEVICE, IMAGE FORMING APPARATUS, DEVELOPING DEVICE CONTROL METHOD

(71) Applicant: KYOCERA Document Solutions Inc., Osaka-shi, Osaka (JP)

(72) Inventors: Yasuhiro Tauchi, Osaka (JP); Yukari Ota, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 15/098,229

(22) Filed: Apr. 13, 2016

(65) Prior Publication Data

US 2016/0306292 A1 Oct. 20, 2016

(30) Foreign Application Priority Data

Apr. 16, 2015 (JP) ..... 2015-084497
Apr. 16, 2015 (JP) ..... 2015-084498

(51) Int. Cl.
*G03G 15/00* (2006.01)
*G03G 15/08* (2006.01)
*G03G 15/06* (2006.01)

(52) U.S. Cl.
CPC ..... *G03G 15/0877* (2013.01); *G03G 15/065* (2013.01)

(58) Field of Classification Search
CPC ..... G03G 15/065; G03G 15/0812; G03G 15/0907; G03G 15/0844; G03G 15/0877; G03G 2215/0634
USPC ..... 399/55
See application file for complete search history.

(56) References Cited

U.S. PATENT DOCUMENTS

2001/0024579 A1* 9/2001 Onuki ..... G03G 15/0266 399/50
2006/0153584 A1* 7/2006 Kyung ..... G03G 15/065 399/55
2008/0240759 A1* 10/2008 Kouno ..... G03G 15/0844 399/55

FOREIGN PATENT DOCUMENTS

JP 2009258276 A 11/2009

* cited by examiner

*Primary Examiner* — Walter L Lindsay, Jr.
*Assistant Examiner* — Jessica L Eley
(74) *Attorney, Agent, or Firm* — Alleman Hall McCoy Russell & Tuttle LLP

(57) ABSTRACT

A developing device includes a toner carrying member, a developer carrying member, a layer thickness restricting portion, a rotation control portion, and a developer carrying member difference voltage control portion. The rotation control portion, when developing is not performed, causes the developer carrying member to rotate forwardly and then to rotate reversely. The developer carrying member difference voltage control portion, in the non-developing forward rotation state, sets a voltage of the developer carrying member that is based on a potential of the toner carrying member, to a voltage that is smaller than a first reference voltage that is set when the developing is performed. The non-developing forward rotation state is a state in which the developer carrying member rotates forwardly when the developing is not performed.

16 Claims, 6 Drawing Sheets

DEVELOPING DEVICE, IMAGE FORMING APPARATUS, DEVELOPING DEVICE CONTROL METHOD

INCORPORATION BY REFERENCE

This application is based upon and claims the benefit of priority from the corresponding Japanese Patent Application No. 2015-084498 filed on Apr. 16, 2015, and No. 2015-084497 filed on Apr. 16, 2015, the entire contents of which are incorporated herein by reference.

BACKGROUND

The present disclosure relates to a developing device, an image forming apparatus, and a developing device control method.

In general, in a developing device installed in an electrophotographic image forming apparatus, the thickness of a layer of developer formed on the surface of a developer carrying member is restricted by a layer thickness restricting portion. The layer thickness restricting portion is called a doctor blade or a restriction blade.

In some cases, the developer carrying member carries a two-component developer which contains toner and carrier. The developing device may include the developer carrying member and a toner carrying member, wherein the developer carrying member rotates while carrying the two-component developer, and the toner carrying member carries the toner supplied from the developer carrying member. In this case, the toner carrying member supplies the toner to an image carrying member on which an electrostatic latent image has been formed, such that the electrostatic latent image is developed by the toner. This developing method is called a touchdown developing or an interactive touchdown developing.

In the developing device, a large amount of toner and/or carrier separated from the developer carrying member may be deposited or adhered to the surface of the layer thickness restricting portion. The toner deposited on the layer thickness restricting portion is easy to move to the image carrying member, which may have an adverse effect on the image quality. In addition, if the developer containing the toner and/or the carrier adheres to the front-edge surface of the layer thickness restricting portion, the layer of the two-component developer formed on the outer circumferential surface of the developer carrying member becomes thinner. This results in a degradation of the image quality.

There is known a technology in which the developer carrying member carrying the two-component developer thereon is rotated in a direction reverse to a rotation direction of the developing, in order to remove the toner that has deposited on the layer thickness restricting portion. In this case, the magnetic brush of the two-component developer formed on the surface of the developer carrying member rubs off the toner deposited on the layer thickness restricting portion.

SUMMARY

A developing device according to an aspect of the present disclosure includes a toner carrying member, a developer carrying member, a layer thickness restricting portion, a rotation control portion, and a developer carrying member difference voltage control portion. The toner carrying member is configured to rotate while carrying toner on an outer circumferential surface thereof such that an electrostatic latent image formed on an image carrying member is developed by the toner. The developer carrying member is configured to rotate in a first rotation direction while carrying two-component developer containing the toner and carrier on an outer circumferential surface thereof such that the toner is supplied to the toner carrying member. The layer thickness restricting portion is disposed with a gap from the developer carrying member at a position that is, on an outer circumference of the developer carrying member, more on an upstream side in the first rotation direction than a position that faces the toner carrying member, and is configured to restrict thickness of a layer of the two-component developer carried by the developer carrying member. The rotation control portion is configured to, when developing is not performed, cause the developer carrying member to rotate in the first rotation direction and then to rotate in a second rotation direction that is reverse to the first rotation direction. The developer carrying member difference voltage control portion is configured to, in a non-developing forward rotation state in which the developer carrying member rotates in the first rotation direction when the developing is not performed, set a developer carrying member difference voltage to a voltage that is smaller than a developer carrying member reference voltage that is set when the developing is performed, the developer carrying member difference voltage being a voltage of the developer carrying member based on a potential of the toner carrying member under a bias voltage applied to between the toner carrying member and the developer carrying member.

An image forming apparatus according to another aspect of the present disclosure includes an image carrying member, the developing device according to the aspect of the present disclosure, and a transfer portion. An electrostatic latent image is formed on a surface of the image carrying member. The developing device develops the electrostatic latent image by supplying toner to the image carrying member. The transfer portion transfers an image of the toner formed on the image carrying member to a sheet member.

A developing device control method according to a further aspect of the present disclosure includes the following two steps: a step of, when developing is not performed, causing the developer carrying member to rotate in the first rotation direction and then to rotate in a second rotation direction that is reverse to the first rotation direction; and a step of, in the non-developing forward rotation state, setting the developer carrying member difference voltage to a voltage that is smaller than a voltage that is set when the developing is performed.

A developing device according to a still further aspect of the present disclosure includes a toner carrying member, a developer carrying member, a layer thickness restricting portion, a rotation control portion, and a layer thickness restricting portion difference voltage control portion. The toner carrying member is configured to rotate while carrying toner on an outer circumferential surface thereof such that an electrostatic latent image formed on an image carrying member is developed by the toner. The developer carrying member is configured to rotate in a first rotation direction while carrying two-component developer containing the toner and carrier on an outer circumferential surface thereof such that the toner is supplied to the toner carrying member. The layer thickness restricting portion is disposed with a gap from the developer carrying member at a position that is, on an outer circumference of the developer carrying member, more on an upstream side in the first rotation direction than a position that faces the toner carrying member, and is configured to restrict thickness of a layer of the two-component developer carried by the developer carrying member. The rotation control portion is configured to, when developing is not performed, cause the developer carrying member to rotate in a second rotation direction that is reverse to the first rotation direction. The layer thickness restricting portion difference voltage control portion is configured to, in a non-developing reverse rotation state in which the developer carrying member rotates in the second rotation direction when the developing is not performed, set a layer thickness restricting portion difference voltage to a voltage that has a polarity that is the same as a charging polarity of the carrier and is larger than a layer thickness restricting portion reference voltage that is set when the developing is performed, the layer thickness restricting portion difference voltage being a voltage of the layer thickness restricting portion based on a potential of the developer carrying member.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following is an embodiment of the present disclosure described with reference to the attached drawings. It should be noted that the following embodiment is an example of a specific embodiment of the present disclosure and should not limit the technical scope of the present disclosure.

[Configuration of Image Forming Apparatus 10]

Figure 1:
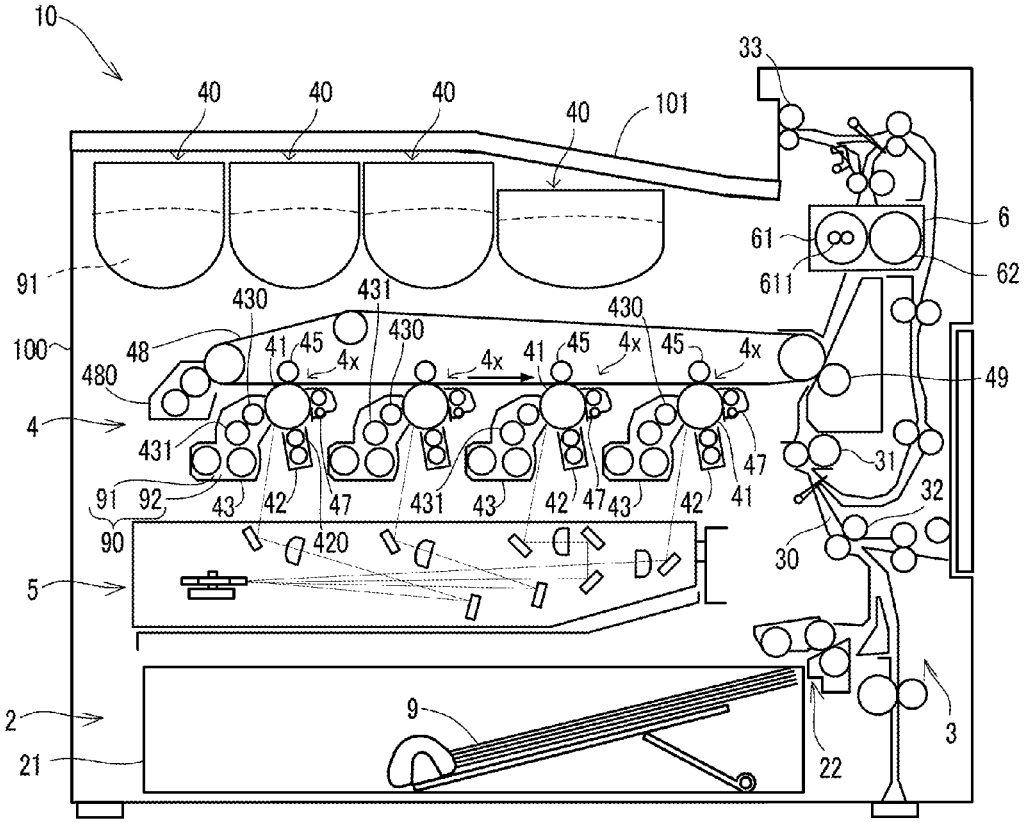
FIG. 1 is a configuration diagram of an image forming apparatus including a developing device according to an embodiment.

First, a description is given of a configuration of an image forming apparatus 10 according to the present embodiment with reference to FIG. 1. The image forming apparatus 10 is an electrophotographic image forming apparatus.

As shown in FIG. 1, the image forming apparatus 10 includes, in a housing 100, a sheet supply portion 2, a sheet conveying portion 3, toner supply portions 40, an image forming portion 4, a laser scanning portion 5, and a fixing portion 6. Furthermore, the image forming apparatus 10 includes a control portion 8, wherein the control portion 8 also constitutes a part of developing devices 43.

The image forming apparatus 10 shown in FIG. 1 is a tandem image forming apparatus and is a color printer. As a result, the image forming portion 4 includes an intermediate transfer belt 48 and a secondary transfer device 49.

In addition, the image forming portion 4 includes a plurality of single-color image forming portions 4*x* that respectively correspond to the colors of cyan, magenta, yellow and black. Furthermore, the image forming apparatus 10 includes a plurality of toner supply portions 40 that supply toner 91 of the colors cyan, magenta, yellow and black respectively to a plurality of developing devices 43.

It is noted that the image forming apparatus 10 is, for example, a printer, a copier, a facsimile, or a multifunction peripheral. The multifunction peripheral has a function of the printer, a function of the copier, and the like.

The sheet supply portion 2 includes a sheet receiving portion 21 and a sheet feed portion 22. The sheet receiving portion 21 is configured to store a plurality of sheet members 9 stacked therein. It is noted that the sheet member 9 is a sheet-like image formation medium such as a sheet of paper, a sheet of coated paper, a postcard, an envelope, or an OHP sheet.

The sheet feed portion 22 is configured to feed a sheet member 9 from the sheet receiving portion 21 to a conveyance path 30, by rotating while in contact with the sheet member 9.

The sheet conveyance portion 3 includes a registration roller 31, a conveyance roller 32 and a discharge roller 33. The registration roller 31 and the conveyance roller 32 convey the sheet member 9 supplied from the sheet supply portion 2, to the secondary transfer device 49 of the image forming portion 4. Furthermore, the discharge roller 33 discharges the sheet member 9 after image formation, onto a discharge tray 101 from a discharge port of the conveyance path 30.

The intermediate transfer belt 48 is an endless belt-like member formed in the shape of a loop. The intermediate transfer belt 48 is rotated in the state of being suspended between two rollers. In the image forming portion 4, the single-color image forming portions 4*x* form images of respective colors on the surface of the rotating intermediate transfer belt 48. With this operation, the images of different colors are overlaid and a color image is formed on the intermediate transfer belt 48.

The secondary transfer device 49 transfers the toner image formed on the intermediate transfer belt 48 to the sheet member 9. A secondary cleaning device 480 removes, from the intermediate transfer belt 48, toner that has remained there after the transfer by the secondary transfer device 49.

Each of the single-color image forming portions 4*x* includes a photoconductor drum 41 that carries a toner image, a charging device 42, a developing device 43, a primary transfer device 45, and a primary cleaning device 47. The charging device 42, the developing device 43, the primary transfer device 45 and the primary cleaning device 47 are disposed to face the photoconductor drum 41 from different directions respectively. It is noted that the photoconductor drum 41 is an example of the image-carrying member that carries a toner image while rotating.

The photoconductor drums 41 rotate at a peripheral speed (moving speed) that corresponds to a peripheral speed of the intermediate transfer belt 48. The photoconductor drum 41 may be, for example, an organic photoconductor. In addition, the photoconductor drum 41 may be an amorphous silicon photoconductor.

In each of the single-color image forming portions 4*x*, the photoconductor drum 41 rotates and the charging device 42 uniformly charges the surface of the photoconductor drum 41. Furthermore, the laser scanning portion 5 writes an electrostatic latent image on the charged surface of the photoconductor drum 41 by scanning a laser beam thereon. The developing device 43 develops the electrostatic latent image on the photoconductor drum 41 by supplying the toner 91 to the photoconductor drum 41.

The developing device 43 charges the toner 91 by stirring two-component developer 90 that includes the toner 91 and carrier 92, and supplies the charged toner 91 to the photoconductor drum 41. This allows the electrostatic latent image formed on the photoconductor drum 41 to be visualized as the toner image.

The carrier 92 is a granular material having magnetism. The carrier 92 may be, for example, a granular material including magnetic body particles which are each coated with a film of synthetic resin such as epoxy resin.

The primary transfer devices 45 transfer the toner images on the surfaces of the photoconductor drums 41 to the intermediate transfer belt 48 that is moving along the surfaces of the photoconductor drums 41. Furthermore, the primary cleaning devices 47 remove the toner 91 that has remained on the surfaces of the photoconductor drums 41.

The secondary transfer device 49 transfers the toner images transferred on the intermediate transfer belt 48 to the sheet member 9 that is moving in the conveyance path 30. It is noted that the primary transfer device 45 and the secondary transfer device 49 are an example of the transfer portion that transfers the images of the toner 91 formed on the photoconductor drums 41 to the sheet member 9.

The fixing portion 6 is a device that fixes the toner image to the sheet member 9 by applying heat thereto. The fixing portion 6 includes a heating roller 61 and a pressure roller 62.

The heating roller 61 includes a heater 611 inside and rotates while contacting the sheet member 9 that is moving in the conveyance path 30 in a heated state. The heating roller 61 and the pressure roller 62 feed the sheet member 9 with an image formed thereon to a downstream process while nipping the sheet member 9 therebetween. This allows the fixing portion 6 to heat the toner image on the sheet member 9 and fix the image to the sheet member 9.

The control portion 8 controls various types of equipment included in the image forming apparatus 10. In the present embodiment, at least portions of the control portion 8 that control the drive system and other electric devices of the developing device 43 constitute a part of the developing device 43.

[Configuration of Developing Device 43]

Figure 2:
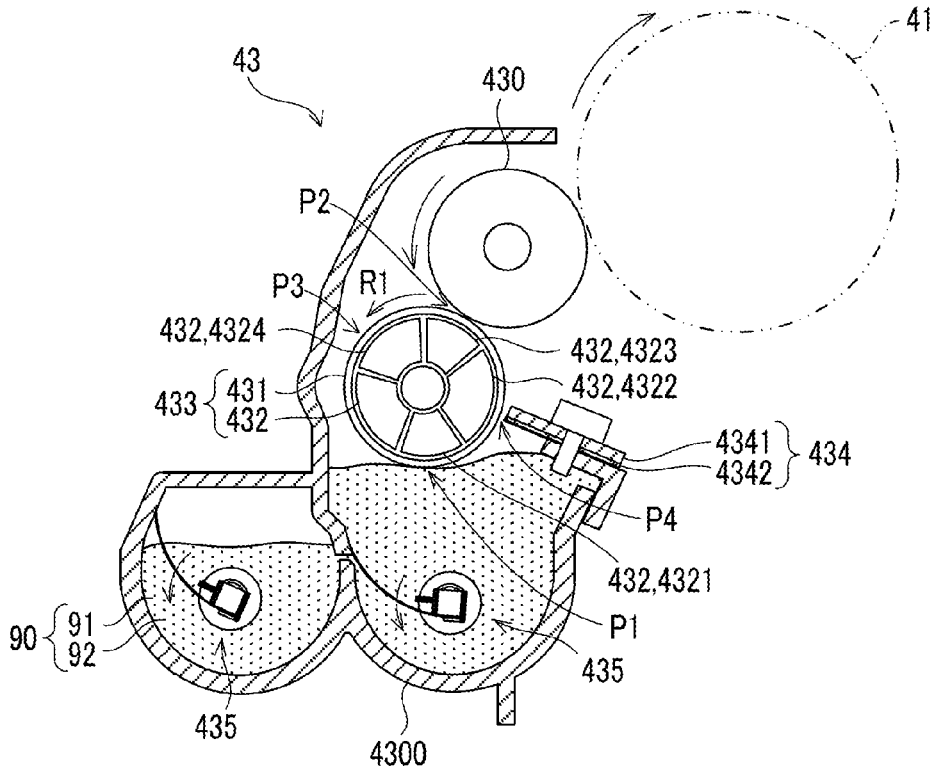
FIG. 2 is a configuration diagram of a main part of the developing device according to an embodiment.

Next, the configuration of the developing device 43 is described with reference to FIG. 2 and FIG. 3. As shown in FIG. 2, the developing device 43 includes a developing tank 4300, a developing roller 430, a rotation sleeve 431, magnets 432, a blade 434, and stirring mechanisms 435. The magnets 432 and the rotation sleeve 431 that covers the magnets 432 constitute a magnetic roller 433. The rotation sleeve 431 is a non-magnetic body.

Figure 3:
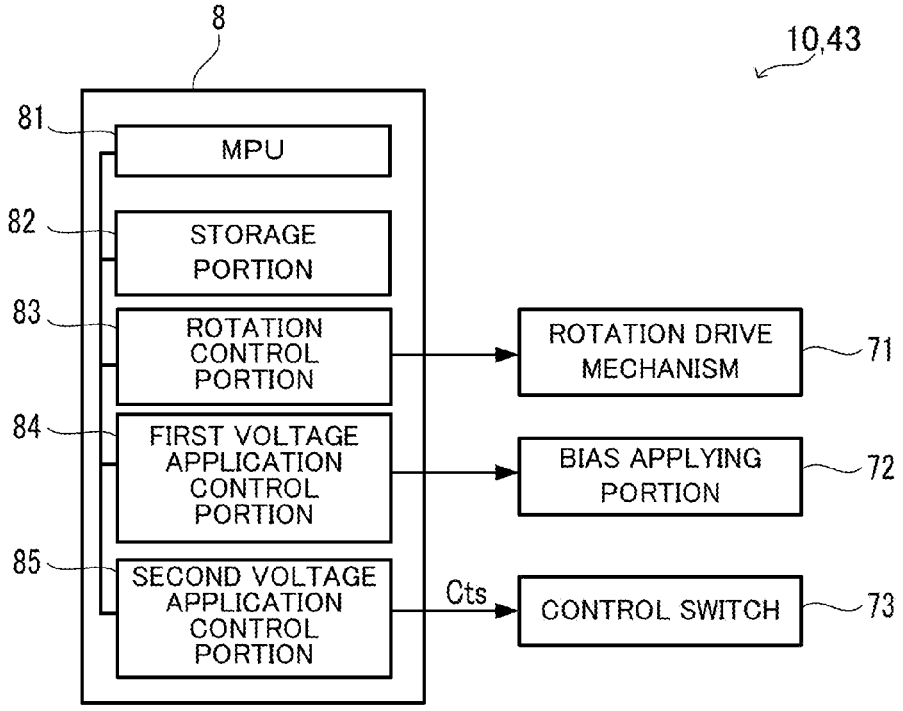
FIG. 3 is a block diagram of control-related portions of the developing device according to an embodiment.

In addition, as shown in FIG. 3, the control portion 8 includes a MPU (Micro Processor Unit) 81, a storage portion 82, a rotation control portion 83, a first voltage application control portion 84, and a second voltage application control portion 85.

The developing tank 4300 is a container for storing the two-component developer 90. The developing roller 430 and the rotation sleeve 431 are rotatably supported. The rotation sleeve 431 and the stirring mechanisms 435 are provided in the developing tank 4300.

The stirring mechanisms 435 stir the two-component developer 90 in the developing tank 4300 by rotating in the developing tank 4300. The toner 91 is electrically charged when it is stirred.

The rotation sleeve 431 is a rotator that rotates while carrying the stirred two-component developer 90. The rotation sleeve 431 rotates in a first rotation direction R1 while carrying the two-component developer 90. With this operation, the rotation sleeve 431 conveys the two-component developer 90 from a first position P1 that is a lower position where the two-component developer 90 is carried onto the rotation sleeve 431, to a third position P3 via a second position P2 that faces the developing roller 430.

At the second position P2, the rotation sleeve 431 supplies the toner 91 among the carried two-component developer 90, to the developing roller 430. That is, the rotation sleeve 431 rotates in the first rotation direction R1 while carrying, on its outer circumferential surface, the two-component developer 90 including the toner 91 and the carrier 92 and supplies the toner 91 to the developing roller at the second position P2. The rotation sleeve 431 is an example of the developer carrying member.

The developing roller 430 rotates while carrying the toner 91 supplied from the rotation sleeve 431 on its outer circumferential surface. By moving in this way, the developing roller 430 supplies the toner 91 to the electrostatic latent image on the outer circumferential surface of the photoconductor drum 41. This allows the electrostatic latent image to be developed as the toner image.

That is, the developing roller 430 is an example of the toner carrying member that allows the electrostatic latent image formed on the photoconductor drum 41 to be developed by the toner, by rotating while carrying the toner 91 on its outer circumferential surface. It is noted that the photoconductor drum 41 is an example of the image carrying member on which the electrostatic latent image is formed.

The rotation sleeve 431 suction-holds the carrier 92 from the first position P1 to the third position P3 by the magnetism of a plurality of magnets 432 provided inside the rotation sleeve 431. For example, the rotation sleeve 431 includes a first magnet 4321, a second magnet 4322, a third magnet 4323, and a fourth magnet 4324 that are aligned in order from the lower position along the first rotation direction R1. The third magnet 4323 is provided at a position facing the developing roller 430.

The first magnet 4321 and the third magnet 4323 have the same polarity, and the second magnet 4322 and the fourth magnet 4324 have the same polarity. The magnetic field formed by the plurality of magnets 432 causes the carrier 92, as well as the toner 91 adhered to the circumference thereof, to be adhered to the outer circumferential surface of the rotation sleeve 431.

Figure 5:
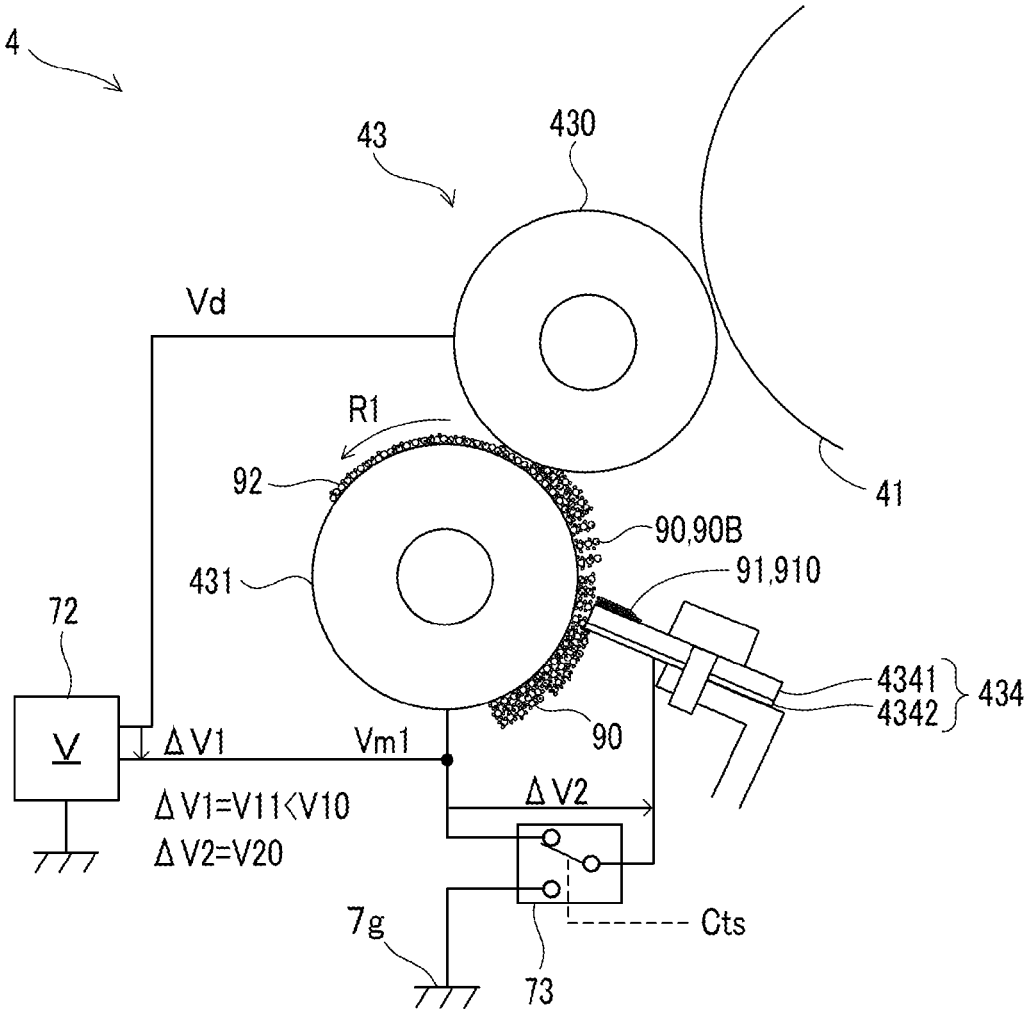
FIG. 5 is a diagram showing a forward rotation operation state while the developing device according to an embodiment is not performing the developing.

A plurality of particles of carrier 92 adhered to the rotation sleeve 431 form a magnetic brush 90B in which the particles of carrier 92 form lines erected from the outer circumferential surface of the rotation sleeve 431 by the action of the magnetic field (see FIG. 5). The magnetic brush 90B contacts the outer circumferential surface of the developing roller 430 at the second position P2.

The developing device 43 includes a bias applying portion 72 for applying a bias voltage between the developing roller 430 and the rotation sleeve 431. In the following description, a voltage of the rotation sleeve 431 based on the potential of the developing roller 430 under the bias voltage, is referred to as a first difference voltage ΔV1. It is noted that the first difference voltage ΔV1 corresponds to the developer carrying member difference voltage.

When developing is performed, the bias applying portion 72 applies a bias voltage between the developing roller 430 and the rotation sleeve 431 such that the polarity of the first difference voltage ΔV1 becomes the same as the charging polarity of the toner 91. Hereinafter, the first difference voltage ΔV1 that is set when developing is performed is referred to as a first reference voltage V10. It is noted that the first reference voltage V10 corresponds to the developer carrying member reference voltage.

In addition, the carrier 92 is charged reverse to the charging polarity of the toner 91 by the frictional charging. A voltage Vm of the rotation sleeve 431 based on the ground potential has a polarity that is reverse to the charging polarity of the carrier 92.

For example, when the charging polarity of the toner 91 is plus, a bias voltage is applied between the developing roller 430 and the rotation sleeve 431 such that the polarity of the first difference voltage ΔV1 becomes plus. In addition, when the charging polarity of the toner 91 is plus, the charging polarity of the carrier 92 is minus. As a result, the polarity of the voltage Vm of the rotation sleeve 431 based on the ground potential is plus.

By the action of the first difference voltage ΔV1 between the developing roller 430 and the rotation sleeve 431, only charged toner 91 among the magnetic brush 90B formed on the surface of the rotation sleeve 431 moves to the developing roller 430. Furthermore, due to the potential difference between the developing roller 430 and the electrostatic latent image on the photoconductor drum 41, the toner 91 flies from the surface of the developing roller 430 to the electrostatic latent image on the photoconductor drum 41.

The developing device 43 that includes the rotation sleeve 431 and the developing rollers 430 develops the electrostatic latent image on the surface of the photoconductor drum 41 by the so-called interactive touchdown method.

The blade 434 is disposed with a gap from the rotation sleeve 431 at a fourth position P4 between the first position P1 and the second position P2 on the outer circumference of the rotation sleeve 431. This allows the blade 434 to restrict the layer thickness of the two-component developer 90 carried by the rotation sleeve 431. The blade 434 is an example of the layer thickness restricting portion. It is noted that, on the outer circumference of the rotation sleeve 431, the fourth position P4 is more on the upstream side in the first rotation direction R1 than the second position P2 that faces the developing roller 430.

In the present embodiment, the blade 434 has a layered configuration in which a first plate 4341 and a second plate 4342 are overlapped, wherein the first plate 4341 is a non-magnetic body and the second plate 4342 is a magnetic body. For example, the blade 434 may be a clad material that is made by joining two metal members by rolling. In addition, the first plate 4341 may be formed to be thicker than the second plate 4342. Such a layered configuration of the blade 434 provides the following advantageous effects: it is possible to secure a sufficient strength of the blade 434; and it is possible to uniformize the layer of the developer 90 by the magnetic lines of force concentrated on the thin magnetic body.

For example, the first plate 4341 may be a plate-like member composed of mainly alumite. In addition, the second plate 4342 may be a plate-like member composed of mainly stainless steel material. In the example shown in FIG. 5, the first plate 4341 is positioned more on the downstream side in the first rotation direction R1 than the second plate 4342.

The MPU 81 of the control portion 8 is a processor that comprehensively controls the devices of the image forming apparatus 10 by running control programs stored in the storage portion 82 in advance. The storage portion 82 is a nonvolatile information storage medium for storing the control programs and other information.

It is noted that the control portion 8 also includes a volatile storage portion (not shown) such as a RAM for temporarily storing a control program. The volatile storage portion temporarily stores a control program that is being run by the MPU 81.

The rotation control portion 83 controls the operation of a rotation drive mechanism 71 included in the developing device 43. The rotation drive mechanism 71 includes a gear mechanism and a motor for rotatably driving the developing roller 430, the rotation sleeve 431, the stirring mechanisms 435 and the like.

When developing is performed, the rotation control portion 83 controls the rotation drive mechanism 71 to rotate the rotation sleeve 431 in the first rotation direction R1 at a speed that has been set in advance. In that case, the rotation drive mechanism 71 causes the developing roller 430, the rotation sleeve 431 and the stirring mechanisms 435 to rotate in conjunction with each other. Furthermore, the rotation drive mechanism 71 causes the photoconductor drum 41 to rotate in conjunction with those components, as well.

The first voltage application control portion 84 controls the bias applying portion 72. It is noted that the developing device 43 of the present embodiment also includes a control switch 73 and the second voltage application control portion 85 that controls the control switch 73. A description of these is given below.

Meanwhile, in the electrophotographic developing device 43, a large amount of toner 91 and/or carrier 92 separated from the rotation sleeve 431 may be deposited or adhered to the surface of the blade 434. The toner 91 deposited on the blade 434 is easy to move to the photoconductor drum 41, which may have an adverse effect on the image quality. In addition, if the developer containing the toner 91 and/or the carrier 92 adheres to the front-edge surface of the blade 434, the layer of the two-component developer 90 formed on the outer circumferential surface of the rotation sleeve 431 becomes thinner. This results in a degradation of the image quality.

According to an experiment, when the blade 434 of the layered configuration composed of the first plate 4341 and the second plate 4342 is adopted, the developer that contains the toner 91 and/or the carrier 92 is easy to adhere to the front-edge surface of the blade 434. In this case, the developer adheres to the front-edge surface of the blade 434 growing from the boundary between the first plate 4341 and the second plate 4342.

For example, in the case of the blade 434 including the first plate 4341 composed of mainly alumite and the second plate 4342 composed of mainly stainless steel material, the developer adheres to the front-edge surface of the blade 434 growing from the boundary between the two plates toward the second plate 4342 side.

There is known a technology in which the rotation sleeve 431 carrying the two-component developer 90 thereon is rotated in the reverse direction to the rotation direction of the rotation sleeve 431 during the developing, in order to remove the toner 91 that has deposited on the blade 434. In this case, the magnetic brush of the two-component developer 90 formed on the surface of the rotation sleeve 431 rubs off the toner 91 deposited on the blade 434.

It is desired, however, to enhance the performance for removing the developer containing the toner 91 and/or the carrier 92 deposited or adhered to the blade 434. Here, with the adoption of the developing device 43, it is possible to efficiently remove the developer containing the toner 91 and/or the carrier 92 deposited or adhered to the blade 434. The following is a detailed description thereof.

In the developing device 43, the control portion 8 performs a non-developing-time operation control to rotate the rotation sleeve 431 when the developing is not performed. The non-developing-time operation control is performed to remove the toner 91 that has been deposited on the blade 434.

For the realization of the non-developing-time operation control, the rotation drive mechanism 71 and the rotation control portion 83 of the control portion 8 are configured to cause the rotation sleeve 431 to rotate in the first rotation direction R1 and in a second rotation direction R2 that is reverse to the first rotation direction R1.

In the following description, the rotation of the rotation sleeve 431 in the first rotation direction R1 is referred to as a forward rotation, and the rotation of the rotation sleeve 431 in the second rotation direction R2 is referred to as a reverse rotation.

The motor included in the rotation drive mechanism 71 may be, for example, a servo motor that can rotate forwardly and reversely in accordance with a control signal from the rotation control portion 83. In addition, the rotation drive mechanism 71 may include a clutch that switches between a connection state and a non-connection state in accordance with a control signal from the rotation control portion 83, wherein in the connection state, the rotational force is transmitted from the motor to the developing roller 430 and the photoconductor drum 41, and in the non-connection state, the transmission of the rotational force is released.

When the clutch switches to the non-connection state, it is possible to cause the rotation sleeve 431 to rotate in the state in which the developing roller 430 and the photoconductor drum 41 are stopped.

As shown in FIG. 3, the developing device 43 includes the control switch 73. Furthermore, the control portion 8 of the developing device 43 includes the second voltage application control portion 85 that controls the control switch 73.

The control switch 73 and the second voltage application control portion 85 are components provided for the non-developing-time operation control that is described below.

The control switch 73 is configured to switch the state in which a voltage is applied to the blade 434. More specifically, the control switch 73 switches between a ground state and a non-ground state in accordance with an input selection signal Cts, wherein in the ground state, the control switch 73 electrically connects the blade 434 to the ground portion, and in the non-ground state, the control switch 73 electrically connects the blade 434 to the rotation sleeve 431.

The second voltage application control portion 85 outputs the selection signal Cts to switch the control switch 73 to either one of the ground state or the non-ground state. When the developing is performed, the second voltage application control portion 85 switches the control switch 73 to the non-ground state by outputting the selection signal Cts.

As a result, a voltage of the blade 434 based on the potential of the rotation sleeve 431 while the developing is performed, is 0V. In the following description, the voltage of the blade 434 based on the potential of the rotation sleeve 431 is referred to as a second difference voltage ΔV2. In addition, the second difference voltage ΔV2 that is set when the developing is performed, is referred to as a second reference voltage V20. It is noted that the second difference voltage ΔV2 corresponds to the layer thickness restricting portion difference voltage. Furthermore, the second reference voltage V20 corresponds to the layer thickness restricting portion reference voltage.

[Non-Developing-Time Operation Control]

Figure 4:
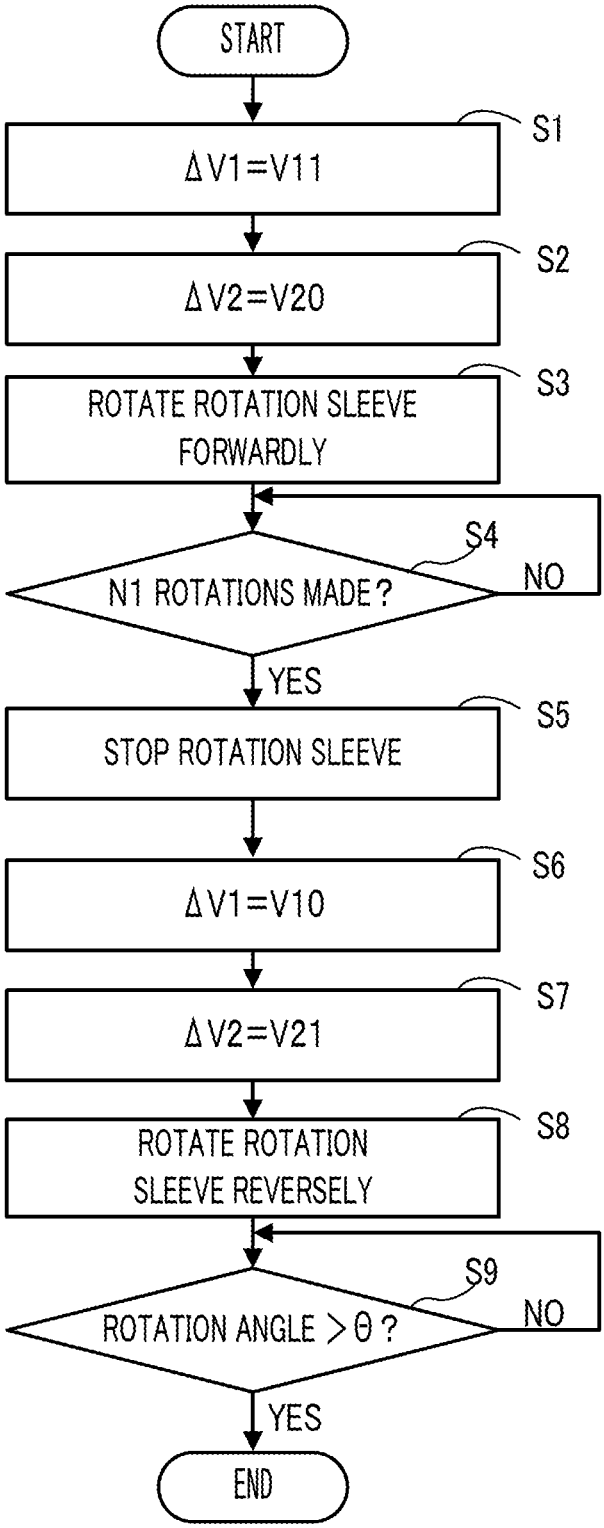
FIG. 4 is a flowchart showing an example of procedures of a non-developing-time operation control in the developing device according to an embodiment.

Next, an example of the procedures of the non-developing-time operation control is described with reference to the flowchart shown in FIG. 4. In the following description, S1, S2, . . . are identification signs representing the steps executed by the control portion 8.

The non-developing-time operation control is started in, for example, a period before the image formation process is started in the case where the image forming apparatus 10 is activated. The non-developing-time operation control may be started in a period between the end of the image formation process performed by the image forming portion 4 until the transition to the power consumption mode.

In the non-developing-time operation control, first, the processes of the following steps S1-S4 are executed. FIG. 5 shows the operation state of the developing device 43 during the execution of the processes of steps S1-S4. It is noted that it suffices that the processes of steps S1-S3 are executed approximately at the same time, and they may be executed in any order.

<Step S1>

In the non-developing-time operation control, the first voltage application control portion 84 sets the first difference voltage ΔV1 to a voltage V11 that is smaller than the first reference voltage V10 that is set when the developing is performed. For example, when the first reference voltage V10 is approximately 300V to 400V, the voltage V11 may be approximately 0V to 70V.

In the example shown in FIG. 5, the first voltage application control portion 84 sets the voltage of the developing roller 430 based on the potential of a ground portion 7*g* to a reference developing voltage Vd, and sets the voltage of the rotation sleeve 431 based on the potential of the ground portion 7*g* to a voltage Vm1. It is noted that the potential of the ground portion 7*g* is the ground potential.

The reference developing voltage Vd is a voltage that is applied to the developing roller 430 when the developing is performed. On the other hand, the voltage Vm1 is a voltage that is close to 0V than a reference sleeve voltage Vm0 that is applied to the rotation sleeve 431 when the developing is performed.

For example, when the charging polarity of the toner 91 is plus, the reference developing voltage Vd is approximately 60V to 120V, and the reference sleeve voltage Vm0 is approximately 420V to 480V. In this case, the voltage V11 can be set to approximately 0V to 70V by setting the voltage Vm1 to approximately 60V to 170V.

<Step S2>

Furthermore, the second voltage application control portion 85 sets the second difference voltage ΔV2 to the second reference voltage V20 that is set when the developing is performed. For example, the second reference voltage V20 may be 0V.

In the present embodiment, the second reference voltage V20 is 0V. In step S2, the second voltage application control portion 85 switches the control switch 73 to the non-ground state by the selection signal Cts. This allows the blade 434 to be electrically connected to the rotation sleeve 431 to which a voltage of a reverse polarity to the charging polarity of the carrier 92 has been applied, and the second reference voltage V20 becomes 0V.

<Step S3>

Furthermore, the rotation control portion 83 rotates the rotation sleeve 431 forwardly. While the rotation sleeve 431 rotates forwardly, the state in which the first difference voltage ΔV1 is set to the voltage V11 and the second difference voltage ΔV2 is set to the second reference voltage V20, continues.

When the processes of steps S1 to S3 are executed, the apparatus enters a state in which the rotation sleeve 431 rotates in the first rotation direction R1 when the developing is not performed. Hereinafter, this state is referred to as a non-developing forward rotation state. FIG. 5 shows the developing device 43 in the non-developing forward rotation state.

In the non-developing forward rotation state, the first difference voltage ΔV1 under the bias voltage is set to the voltage V11 that is smaller than the first reference voltage V10 that is set when the developing is performed (S1). In this case, the force of the rotation sleeve 431 that attracts the carrier 92 by the attraction of the first difference voltage ΔV1 becomes weak. As a result, the magnetic brush 90B at the second position P2 moves closer to the developing roller 430 than when the developing is performed.

This makes it easy for a large amount of two-component developer 90 to retain at an entrance of a gap between the rotation sleeve 431 and the developing roller 430.

For example, in the non-developing forward rotation state, the rotation control portion 83 may cause the rotation sleeve 431 to rotate at a higher speed than a reference speed at which the rotation sleeve 431 rotates when the developing is performed.

<Step S4>

The rotation control portion 83 continues the non-developing forward rotation state until the rotation sleeve 431 makes as many rotations as a predetermined number of rotations N1. The number of rotations N1 is greater than 1 (one).

By way of example, the rotation control portion 83 may detect the number of rotations of the rotation sleeve 431 by counting an elapse of a predetermined time period. In addition, the rotation control portion 83 may detect the number of rotations of the rotation sleeve 431 by counting the number of oscillations of a drive pulse signal output to the servo motor.

The greater the number of rotations N1 in the non-developing forward rotation state is, the larger the amount of two-component developer 90 that retains at the entrance of the gap between the rotation sleeve 431 and the developing roller 430 is. In addition, the higher the rotation speed of the rotation sleeve 431 in the non-developing forward rotation state is, the shorter is the time that is required for a large amount of two-component developer 90 to retain at the entrance of the gap between the rotation sleeve 431 and the developing roller 430.

<Step S5>

Upon detecting that the rotation sleeve 431 has rotated as many times as the number of rotations N1, the rotation control portion 83 stops the rotation sleeve 431.

Figure 6:
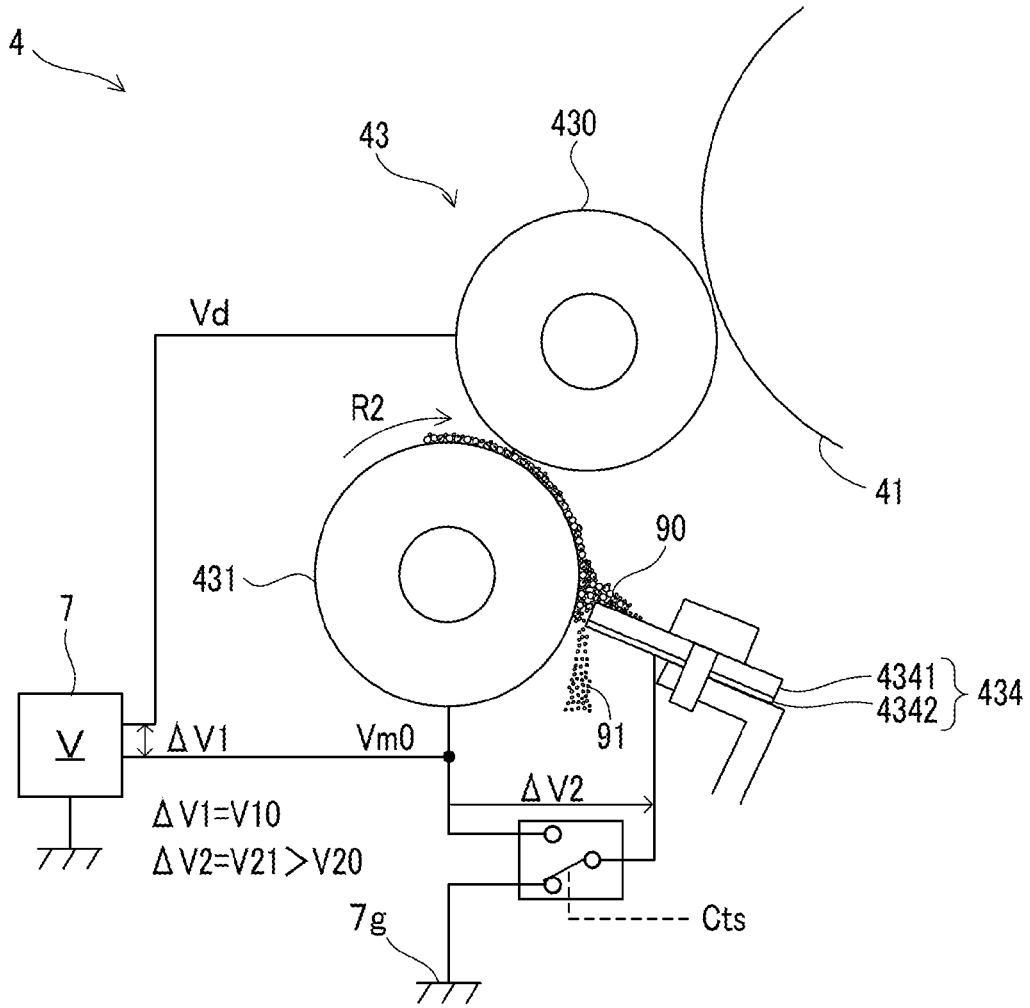
FIG. 6 is a diagram showing a reverse rotation operation state while the developing device according to an embodiment is not performing the developing.

Subsequently, the processes of steps S6 to S9 are executed. FIG. 6 shows the operation state of the developing device 43 during the execution of the processes of steps S6 to S9. It is noted that it suffices that the processes of steps S6 to S9 are executed approximately at the same time, and they may be executed in any order.

<Step S6>

After the non-developing forward rotation state ends, the first voltage application control portion 84 sets the first difference voltage ΔV1 to the first reference voltage V10.

<Step S7>

Furthermore, the second voltage application control portion 85 sets the second difference voltage ΔV2 to a voltage V21 that has a polarity that is the same as the charging polarity of the carrier 92 and is larger than the second reference voltage V20. For example, the second reference voltage V20 may be the reference sleeve voltage Vm0 with the plus/minus reversed. It is noted that the size of voltage mentioned here means an absolute value of the voltage.

In the present embodiment, the second voltage application control portion 85 switches the control switch 73 to the ground state by the selection signal Cts. This allows the blade 434 to be electrically connected to the ground portion 7*g*, and the second reference voltage V20 to be equal to the reference sleeve voltage Vm0. Here, the polarity of the reference sleeve voltage Vm0 is reverse to the charging polarity of the carrier 92.

As described above, when the charging polarity of the toner 91 is plus, namely, when the charging polarity of the carrier 92 is minus, the reference sleeve voltage Vm0 is considered to be approximately 420V to 480V.

<Step S8>

The rotation control portion 83 rotates the rotation sleeve 431 reversely. While the rotation sleeve 431 rotates reversely, the state in which the first difference voltage ΔV1 is set to the first reference voltage V10 and the second difference voltage ΔV2 is set to the voltage V21, continues.

When the processes of steps S6 to S8 are executed, the apparatus enters a state in which the rotation sleeve 431 rotates in the second rotation direction R2 when the developing is not performed. Hereinafter, this state is referred to as a non-developing reverse rotation state. FIG. 6 shows the developing device 43 in the non-developing reverse rotation state.

<Step S9>

The rotation control portion 83 continues the non-developing reverse rotation state until the rotation sleeve 431 rotates by a predetermined angle θ. The angle θ is at least larger than an angle made from the second position P2 and the fourth position P4 sitting on the outer circumference of the rotation sleeve 431. The angle θ may be, for example, approximately 180 degrees to 360 degrees.

The rotation control portion 83 detects the rotation angle of the rotation sleeve 431 by counting an elapse of a predetermined time period, or by counting the number of oscillations of a drive pulse signal output to the servo motor. The non-developing-time operation control ends after step S9.

As described above, according to the present embodiment, when the developing is not performed, the rotation control portion 83 causes the rotation sleeve 431 to rotate in the first rotation direction R1, and then causes it to rotate in the second rotation direction R2 that is reverse to the first rotation direction R1 (steps S3, S4, S8, S9).

In addition, in the non-developing forward rotation state, the first voltage application control portion 84 sets the first difference voltage ΔV1 that is under the bias voltage applied to between the developing roller 430 and the rotation sleeve 431, to the voltage V11 which is smaller than the first reference voltage V10 that is set when the developing is performed (step S1). It is noted that the first voltage application control portion 84 is an example of the developer carrying member difference voltage control portion.

In addition, in the non-developing reverse rotation state, the second voltage application control portion 85 sets the second difference voltage ΔV2 to the voltage V21 that has a polarity that is the same as the charging polarity of the carrier 92 and is larger than the second reference voltage V20 (S7). It is noted that the size of voltage mentioned here means an absolute value of the voltage. It is noted that the second voltage application control portion 85 is an example of the layer thickness restricting portion difference voltage control portion.

More specifically, in the non-developing reverse rotation state, the second voltage application control portion 85 sets the second difference voltage ΔV2 to the voltage V21 that is larger than the second reference voltage V20 by controlling the control switch 73 to be in the ground state.

It is noted that, as described above, the second voltage application control portion 85 sets the second difference voltage ΔV2 to the second reference voltage V20 by controlling the control switch 73 to be in the non-ground state when the developing is performed. In the present embodiment, the second reference voltage V20 is 0V.

In the non-developing reverse rotation state, a large amount of two-component developer 90 that has gathered at the second position P2 in the non-developing forward rotation state contacts, over a wide range, the toner 91 deposited on the blade 434. This allows the toner 91 deposited on the blade 434 to be removed efficiently over a wide range.

In addition, in the non-developing reverse rotation state, the first difference voltage ΔV1 under the bias voltage is set to the first reference voltage V10 that is set when the developing is performed (step S6). In this case, the force of the rotation sleeve 431 that attracts the carrier 92 by the attraction of the first difference voltage ΔV1 becomes strong. Thus, at the fourth position P4, the force of the two-component developer 90 that rubs off the toner 91 deposited on the blade 434 becomes strong. This improves the performance to remove the toner 91 deposited on the blade 434.

Figure 7:
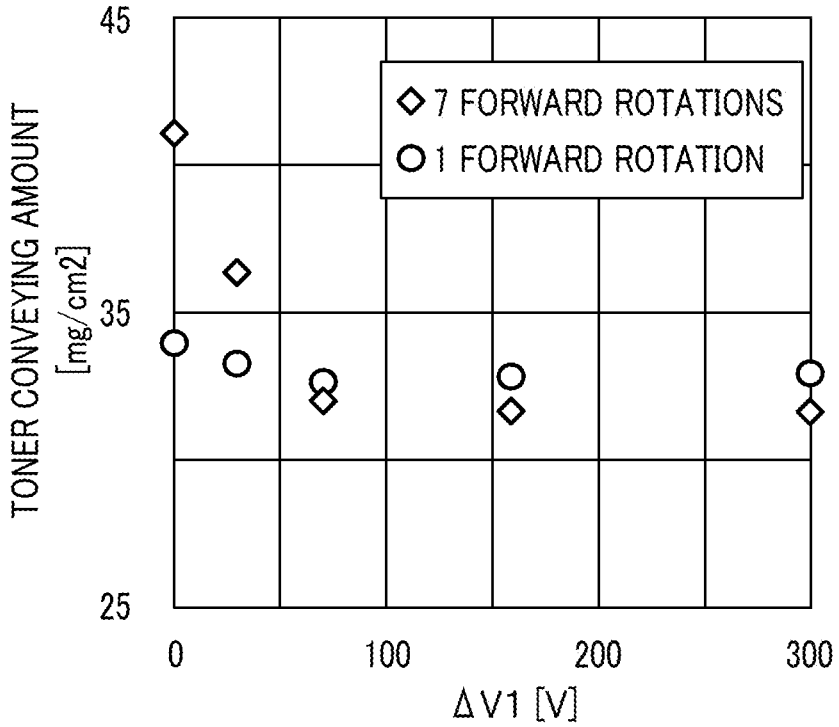
FIG. 7 is a graph of experiment results representing a relationship between a voltage of a rotation sleeve of the developing device based on a potential of a developing roller during a reverse rotation of the rotation sleeve, and an amount of developer conveyed by the rotation sleeve.

FIG. 7 is a graph of the experiment results representing a relationship between the first difference voltage ΔV1 in the non-developing forward rotation state (horizontal axis) and a toner conveying amount after a transition from the non-developing forward rotation state to the non-developing reverse rotation state (vertical axis). The toner conveying amount is an amount of two-component developer 90 per unit area conveyed by the rotation sleeve 431 from the second position P2 to the fourth position P4.

In addition, the graph of FIG. 7 shows the results of an experiment that was conducted for the cases where the number of rotations of the rotation sleeve 431 in the non-developing forward rotation state is one and seven, respectively.

The experiment result of FIG. 7 shows that an effect of increasing the developer conveying amount is obtained when the number of rotations of the rotation sleeve 431 in the non-developing forward rotation state is great than when the number of rotations of the rotation sleeve 431 in the non-developing forward rotation state is small. Thus it is preferable that, in the non-developing forward rotation state in the non-developing-time operation control, more than one rotation of the rotation sleeve 431 is made in the first rotation direction R1. For example, the number of rotations N1 of the rotation sleeve 431 in the non-developing forward rotation state may be two to seven (step S4 in FIG. 4).

In addition, it is possible to cause a large amount of two-component developer 90 to retain at the entrance of the gap between the rotation sleeve 431 and the developing roller 430 in short time, by causing the rotation sleeve 431 to rotate in the non-developing forward rotation state at a higher speed than the reference speed.

Furthermore, the experiment result of FIG. 7 shows that that an effect of increasing the developer conveying amount is obtained when the first difference voltage ΔV1 in the non-developing forward rotation state is set to approximately 30V or lower. In particular, a remarkably high effect of increasing the developer conveying amount is obtained when the first difference voltage ΔV1 in the non-developing forward rotation state is set to 0V.

In the non-developing reverse rotation state, the rotation control portion 83 may cause the rotation sleeve 431 to rotate in the second rotation direction R2 at a lower speed than the reference speed at which the rotation sleeve 431 rotates when the developing is performed. This enables the two-component developer 90 to rub off the toner 91 deposited on the blade 434 in a reliable manner. For example, the rotation speed of the rotation sleeve 431 in the non-developing reverse rotation state may be set to half of the reference speed.

In addition, if the rotation sleeve 431 is merely caused to rotate reversely, the two-component developer 90 on the surface of the rotation sleeve 431 retains at the entrance of the gap between the rotation sleeve 431 and the developing roller 430, due to the frictional resistance received from the front-edge portion of the blade 434. As a result, in that case, the effect that the two-component developer 90 on the surface of the rotation sleeve 431 rubs off the developer adhered to the front-edge surface of the blade 434 cannot be expected.

On the other hand, in the developing device 43, the second difference voltage ΔV2 in the non-developing reverse rotation state is set to a large voltage V21 whose polarity is the same as the charging polarity of the carrier 92. In this case, at the fourth position P4, the force of the rotation sleeve 431 that attracts the carrier 92 becomes strong. As a result, the carrier 92 on the surface of the rotation sleeve 431 enters the gap between the rotation sleeve 431 and the blade 434 against the frictional resistance, thereby efficiently rubs off the developer adhered to the front-edge surface of the blade 434.

In addition, in the non-developing forward rotation state, the second voltage application control portion 85 sets the second difference voltage ΔV2 to the second reference voltage V20 (step S2). In the present embodiment, the second difference voltage ΔV2 is a small voltage such as 0V. With the second difference voltage ΔV2 set to a small voltage, it is possible to avoid that the layer of the developer 90 is disturbed by the potential difference when it pass through the gap between the rotation sleeve 431 and the blade 434.

Furthermore, the developing device 43 includes the control switch 73 for switching the second difference voltage ΔV2. The control switch 73 switches the blade 434 to a state of connecting selectively to either one of the rotation sleeve 431 or the ground portion 7*g*. This eliminates the need to newly include a power source circuit for switching the second difference voltage ΔV2.

In step S6 in the non-developing-time operation control, the first difference voltage ΔV1 may be set to a voltage that is closer to the first reference voltage V10 than the voltage V11 which is the first difference voltage ΔV1 that is set in the non-developing forward rotation state. That is, the first difference voltage ΔV1 in the non-developing reverse rotation state may be set to a voltage that is closer to the first reference voltage V10 than the voltage V11 that is set in the non-developing forward rotation state. In this case, too, the same effect as that in the present embodiment is obtained.

In addition, in the non-developing reverse rotation state, the bias voltage may not be applied.

In addition, in the case where the image forming apparatus 10 can form only monochrome images, the primary transfer device 45 transfers an image of the toner 91 formed on the photoconductor drum 41 directly to the sheet member 9. In this case, the primary transfer device 45 is an example of the transfer portion.

It is noted that the developing device, the image forming apparatus, and the developing device control method of the present disclosure may be configured by, within the scope of claims, freely combining the above-described embodiments and application examples, or by modifying the embodiments and application examples or omitting a part thereof.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A developing device comprising:

a toner carrying member configured to rotate while carrying toner on an outer circumferential surface thereof such that an electrostatic latent image formed on an image carrying member is developed by the toner;

a developer carrying member configured to rotate in a first rotation direction while carrying two-component developer containing the toner and carrier on an outer circumferential surface thereof such that the toner is supplied to the toner carrying member;

a layer thickness restricting portion disposed with a gap from the developer carrying member at a position that is, on an outer circumference of the developer carrying member, more on an upstream side in the first rotation direction than a position that faces the toner carrying member, and configured to restrict thickness of a layer of the two-component developer carried by the developer carrying member;

a rotation control portion configured to, when developing is not performed, cause the developer carrying member to rotate in the first rotation direction and then to rotate in a second rotation direction that is reverse to the first rotation direction; and a developer carrying member difference voltage control portion configured to, in a non-developing forward rotation state in which the developer carrying member rotates in the first rotation direction when the developing is not performed, set a developer carrying member difference voltage to a voltage that is smaller than a developer carrying member reference voltage that is set when the developing is performed, the developer carrying member difference voltage being a voltage of the developer carrying member based on a potential of the toner carrying member under a bias voltage applied to between the toner carrying member and the developer carrying member.

2. The developing device according to claim 1, wherein the rotation control portion, in the non-developing forward rotation state, causes the developer carrying member to make more than one rotation in the first rotation direction.

3. The developing device according to claim 1, wherein the rotation control portion, in the non-developing forward rotation state, causes the developer carrying member to rotate at a speed that is higher than a reference speed at which the developer carrying member rotates when the developing is performed.

4. The developing device according to claim 1, wherein the developer carrying member difference voltage control portion, in a non-developing reverse rotation state in which the developer carrying member rotates in the second rotation direction when the developing is not performed, sets the developer carrying member difference voltage to the developer carrying member reference voltage or a voltage that is closer to the developer carrying member reference voltage than the developer carrying member difference voltage in the non-developing forward rotation state.

5. The developing device according to claim 1 further comprising:

a layer thickness restricting portion difference voltage control portion configured to, in a non-developing reverse rotation state in which the developer carrying member rotates in the second rotation direction when the developing is not performed, set a layer thickness restricting portion difference voltage to a voltage that has a polarity that is the same as a charging polarity of the carrier and is larger than a layer thickness restricting portion reference voltage that is set when the developing is performed, the layer thickness restricting portion difference voltage being a voltage of the layer thickness restricting portion based on a potential of the developer carrying member.

6. The developing device according to claim 5 further comprising:

a switch configured to switch between a ground state in which to electrically connect the layer thickness restricting portion to a ground portion, and a non-ground state in which to connect the layer thickness restricting portion to the developer carrying member to which a voltage of a reverse polarity to the charging polarity of the carrier has been applied, wherein the layer thickness restricting portion difference voltage control portion sets the layer thickness restricting portion difference voltage to the layer thickness restricting portion reference voltage by controlling the switch to be in the non-ground state when the developing is performed, and in the non-developing reverse rotation state, sets the layer thickness restricting portion difference voltage to a voltage that is larger than the layer thickness restricting portion reference voltage by controlling the switch to be in the ground state.

7. The developing device according to claim 1, wherein the rotation control portion, in a non-developing reverse rotation state in which the developer carrying member rotates in the second rotation direction when the developing is not performed, causes the developer carrying member to rotate in the second rotation direction at a speed that is lower than a reference speed at which the developer carrying member rotates when the developing is performed.

8. An image forming apparatus comprising:

an image carrying member on whose surface an electrostatic latent image is formed;

the developing device according to claim 1 that develops the electrostatic latent image by supplying toner to the image carrying member; and a transfer portion configured to transfer an image of the toner formed on the image carrying member to a sheet member.

9. A developing device control method for controlling a developing device including: a toner carrying member configured to rotate while carrying toner on an outer circumferential surface thereof such that an electrostatic latent image formed on an image carrying member is developed by the toner; a developer carrying member configured to rotate in a first rotation direction while carrying two-component developer containing the toner and carrier on an outer circumferential surface thereof such that the toner is supplied to the toner carrying member; and a layer thickness restricting portion disposed with a gap from the developer carrying member at a position that is, on an outer circumference of the developer carrying member, more on an upstream side in the first rotation direction than a position that faces the toner carrying member, and configured to restrict thickness of a layer of the two-component developer carried by the developer carrying member, the developing device control method comprising:

a step of, when developing is not performed, causing the developer carrying member to rotate in the first rotation direction and then to rotate in a second rotation direction that is reverse to the first rotation direction; and a step of, in a non-developing forward rotation state in which the developer carrying member rotates in the first rotation direction when the developing is not performed, setting a developer carrying member difference voltage to a voltage that is smaller than a developer carrying member reference voltage that is set when the developing is performed, the developer carrying member difference voltage being a voltage of the developer carrying member based on a potential of the toner carrying member.

10. A developing device comprising:

a toner carrying member configured to rotate while carrying toner on an outer circumferential surface thereof such that an electrostatic latent image formed on an image carrying member is developed by the toner;

a developer carrying member configured to rotate in a first rotation direction while carrying two-component developer containing the toner and carrier on an outer circumferential surface thereof such that the toner is supplied to the toner carrying member;

a layer thickness restricting portion disposed with a gap from the developer carrying member at a position that is, on an outer circumference of the developer carrying member, more on an upstream side in the first rotation direction than a position that faces the toner carrying member, and configured to restrict thickness of a layer of the two-component developer carried by the developer carrying member;

a rotation control portion configured to, when developing is not performed, cause the developer carrying member to rotate in a second rotation direction that is reverse to the first rotation direction; and a layer thickness restricting portion difference voltage control portion configured to, in a non-developing reverse rotation state in which the developer carrying member rotates in the second rotation direction when the developing is not performed, set a layer thickness restricting portion difference voltage to a voltage that has a polarity that is the same as a charging polarity of the carrier and is larger than a layer thickness restricting portion reference voltage that is set when the developing is performed, the layer thickness restricting portion difference voltage being a voltage of the layer thickness restricting portion based on a potential of the developer carrying member.

11. The developing device according to claim 10 further comprising:

a switch configured to switch between a ground state in which to electrically connect the layer thickness restricting portion to a ground portion, and a non-ground state in which to connect the layer thickness restricting portion to the developer carrying member to which a voltage of a reverse polarity to the charging polarity of the carrier has been applied, wherein the layer thickness restricting portion difference voltage control portion sets the layer thickness restricting portion difference voltage to the layer thickness restricting portion reference voltage by controlling the switch to be in the non-ground state when the developing is performed, and in the non-developing reverse rotation state, sets the layer thickness restricting portion difference voltage to a voltage that is larger than the layer thickness restricting portion reference voltage by controlling the switch to be in the ground state.

12. The developing device according to claim 10, wherein the layer thickness restricting portion has a layered configuration in which a non-magnetic body and a magnetic body are overlapped.

13. The developing device according to claim 10, wherein the rotation control portion, in the non-developing reverse rotation state, causes the developer carrying member to rotate in the second rotation direction at a speed that is lower than a reference speed at which the developer carrying member rotates when the developing is performed.

14. The developing device according to claim 10 further comprising:

a developer carrying member difference voltage control portion configured to set a developer carrying member difference voltage that is a voltage of the developer carrying member based on a potential of the toner carrying member under a bias voltage applied to between the toner carrying member and the developer carrying member, wherein when the developing is not performed, the rotation control portion causes the developer carrying member to rotate in the first rotation direction and then to rotate in the second rotation direction, and the developer carrying member difference voltage control portion, in a non-developing forward rotation state in which the developer carrying member rotates in the first rotation direction when the developing is not performed, sets the developer carrying member difference voltage to a voltage that is smaller than a developer carrying member reference voltage that is set when the developing is performed.

15. The developing device according to claim 14, wherein the layer thickness restricting portion difference voltage control portion, in the non-developing forward rotation state, sets the layer thickness restricting portion difference voltage to the layer thickness restricting portion reference voltage.

16. The developing device according to claim 14, wherein the rotation control portion, in the non-developing forward rotation state, causes the developer carrying member to rotate at a speed that is higher than a reference speed at which the developer carrying member rotates when the developing is performed.

* * * * *